US006622612B2

(12) United States Patent
Notzon

(10) Patent No.: US 6,622,612 B2
(45) Date of Patent: Sep. 23, 2003

(54) PUMP, PARTICULARLY PLUNGER PUMP

(75) Inventor: Stephan Notzon, Herzebrock (DE)

(73) Assignee: Hammelmann Maschinenfabrik GmbH, Oelde (DE)

( * ) Notice: Subject to any disclaimer, the term of this patent is extended or adjusted under 35 U.S.C. 154(b) by 0 days.

(21) Appl. No.: 10/143,887

(22) Filed: May 14, 2002

(65) Prior Publication Data

US 2002/0174767 A1 Nov. 28, 2002

(30) Foreign Application Priority Data

May 25, 2001 (DE) ..... 101 25 669

(51) Int. Cl.[7] ..... F04B 9/02
(52) U.S. Cl. ..... 92/146; 417/503; 417/539
(58) Field of Search ..... 92/146, 141; 417/273, 417/503, 539, 568

(56) References Cited

U.S. PATENT DOCUMENTS 4,087,213 A * 5/1978 Hadama ..... 417/539
4,824,342 A * 4/1989 Buck ..... 417/539

* cited by examiner

*Primary Examiner*—Edward K. Look
*Assistant Examiner*—Thomas E. Lazo
(74) *Attorney, Agent, or Firm*—Barnes & Thornburg

(57) ABSTRACT

A pump, particularly a plunger pump, comprises a crank mechanism oscillating a plunger in a housing and an elastic sealing device fastened to the plunger. The sealing device provides a pressure-tight sealing with respect to a lower housing space containing the crank mechanism. As a result, an intermediate space in the housing may be filled with air. The intermediate space is hermetically separated from the lower housing space containing the crank mechanism.

9 Claims, 3 Drawing Sheets

PUMP, PARTICULARLY PLUNGER PUMP

BACKGROUND AND SUMMARY OF THE INVENTION

The present invention relates to a pump, particularly a plunger pump, having a crank mechanism which, in an oscillating manner, drives a plunger arranged in a housing and guided in a receiving device, and having a pump head fixed to the housing for guiding the pressurized fluid, the housing surrounding the crank mechanism and the plunger.

Plunger pumps exist which are used in the high-pressure water field because they have a compact construction and can be used in an operationally reliable manner at pressures between 100 and 3,000 bar. With respect to other pump constructions, such as rotating positive-displacement pumps, these plunger pumps have the advantage of a good energy efficiency. Also, they are capable of delivering also under difficult fluid conditions, such as high temperature, barely viscous and very viscous media as well as solid-charged liquids. The plunger pumps run relatively quietly, cause low vibrations and are relatively easy to maintain. It is a disadvantage in the case of these vertically arranged plunger pumps that oil is present in the lower housing part having the crank mechanism. In comparison to the upper housing area, this housing area has to be mounted by corresponding strippers or a suction space sealing whose installation requires high expenditures. For this purpose, the surface of the piston rod must be machined in order to accommodate a corresponding sealing ring.

It is therefore an object of the present invention to provide a pump, particularly a plunger pump of the initially mentioned type, in which a reliable sealing with respect to the lower housing space containing the crank mechanism is provided in a simple manner and which can be used also under extreme environmental conditions.

This object is achieved by the pump of the present invention.

If elastic sealing devices are fixed to the plunger which provide a pressure-tight sealing with respect to the lower housing space containing the crank mechanism, the plunger or a vertical sealing and guiding element fastened to the plunger no longer has to be guided in a receiving device with particularly high precision in order to generate a sealing with respect to the upper housing part. A machining of the surface of the plunger rod for sealing ring receiving devices, for example, can be eliminated, or a sliding ring or rotary shaft seal can be saved. In this case, the elastic sealing devices can be used, among other things, as a splash guard in order to avoid an admission of oil from the area of the crank mechanism into the upper housing part. Such a hermetic sealing-off of the lower housing part is advantageous particularly for chemical pumps, because such a medium- and water-jet-resistant sealing has so far only been possible by diaphragm pumps. In particular, when the fluid to be delivered contains dirt, is toxic, harmful, corrosive, explosive or combustible, the advantages of a hermetic sealing are important. When the fluid is poorly lubricating, a driving mechanism lubrication could be used without a corresponding sealing.

According to a preferred embodiment of the invention, a space is formed in the housing above the lower housing space and below the pump head. This space may be filled with air. This creates a clear separation between a fluid space in the pump head, the space which is filled with air, and the space of the crank mechanism containing oil.

The sealing device is preferably fastened to the plunger on one side and to the housing on the opposite side. The mounting is facilitated in this case by interior webs constructed on the housing which surround the plunger in a ring-shaped manner so that the sealing devices are only clamped onto this housing section. In order to have sufficient elasticity for the movement of the plunger, the sealing device can be constructed as ring-shaped or conical bellows. A conical construction of the bellows has the advantage that a buckling is prevented. The waves provided on the bellows should be provided in such a number that no fluttering will occur even at high stroke frequencies. In the case of a gas-tight construction of the sealing devices, the pump can be used in an extreme environment.

The plunger may be constructed in several parts in order to be able to clamp the sealing device to a lower plunger element. In the upper area, the plunger is received in a piston-type manner in a bush or receiving device for the plunger sealing.

According to another embodiment of the invention, the pump has several adjacent plungers and sealing devices with respect to a lower housing space are provided around each plunger. The several plungers can then be combined to form a common pump unit in order to provide a high delivery volume. The pump is therefore preferably constructed as a high-pressure plunger pump.

These and other aspects of the present invention will become apparent from the following detailed description of the invention, when considered in conjunction with accompanying drawings.

DETAILED DESCRIPTION OF THE PREFERRED EMBODIMENTS

Figure 1:
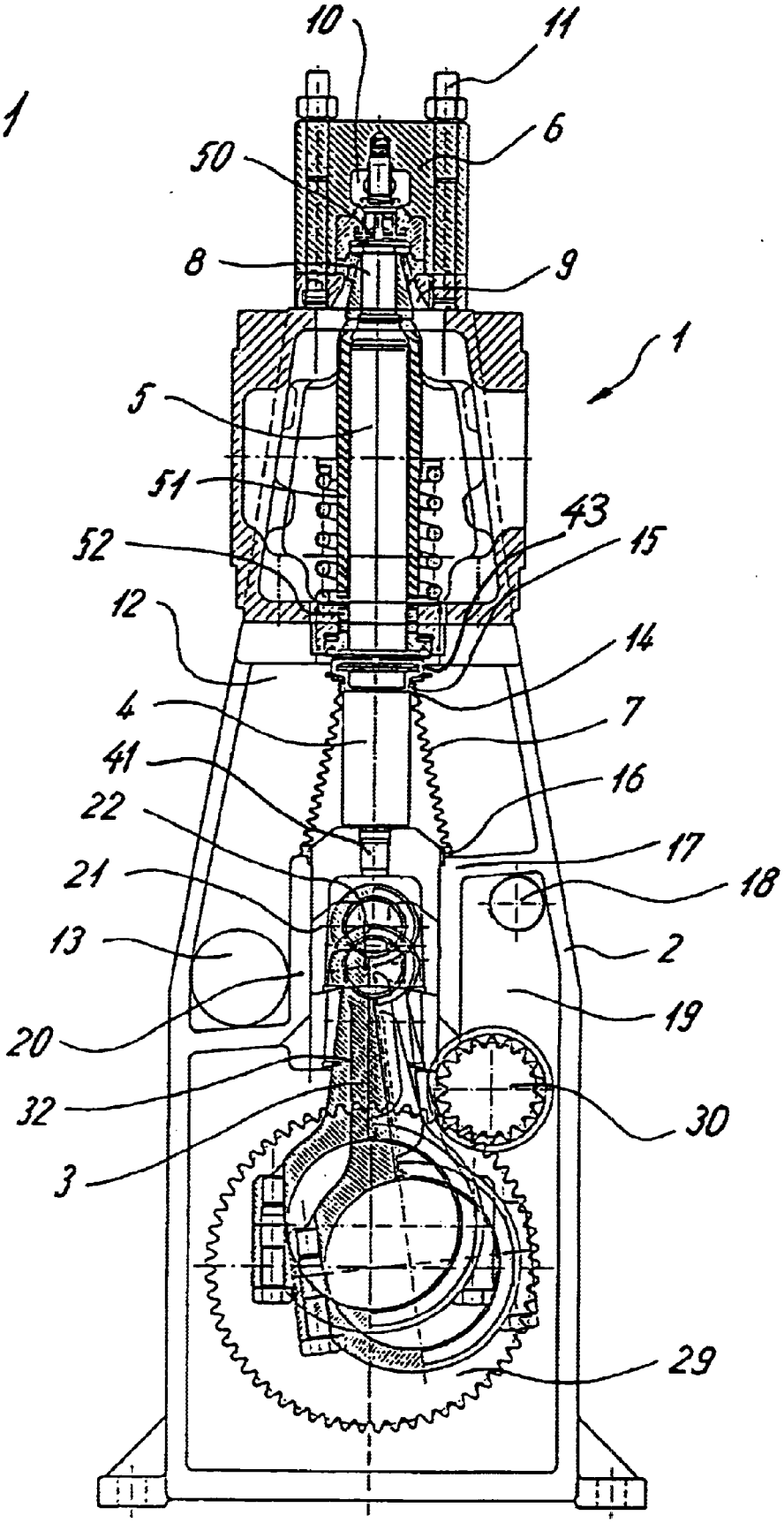
FIG. 1 is a lateral sectional view of an embodiment of a pump according to the invention.
Figure 2:
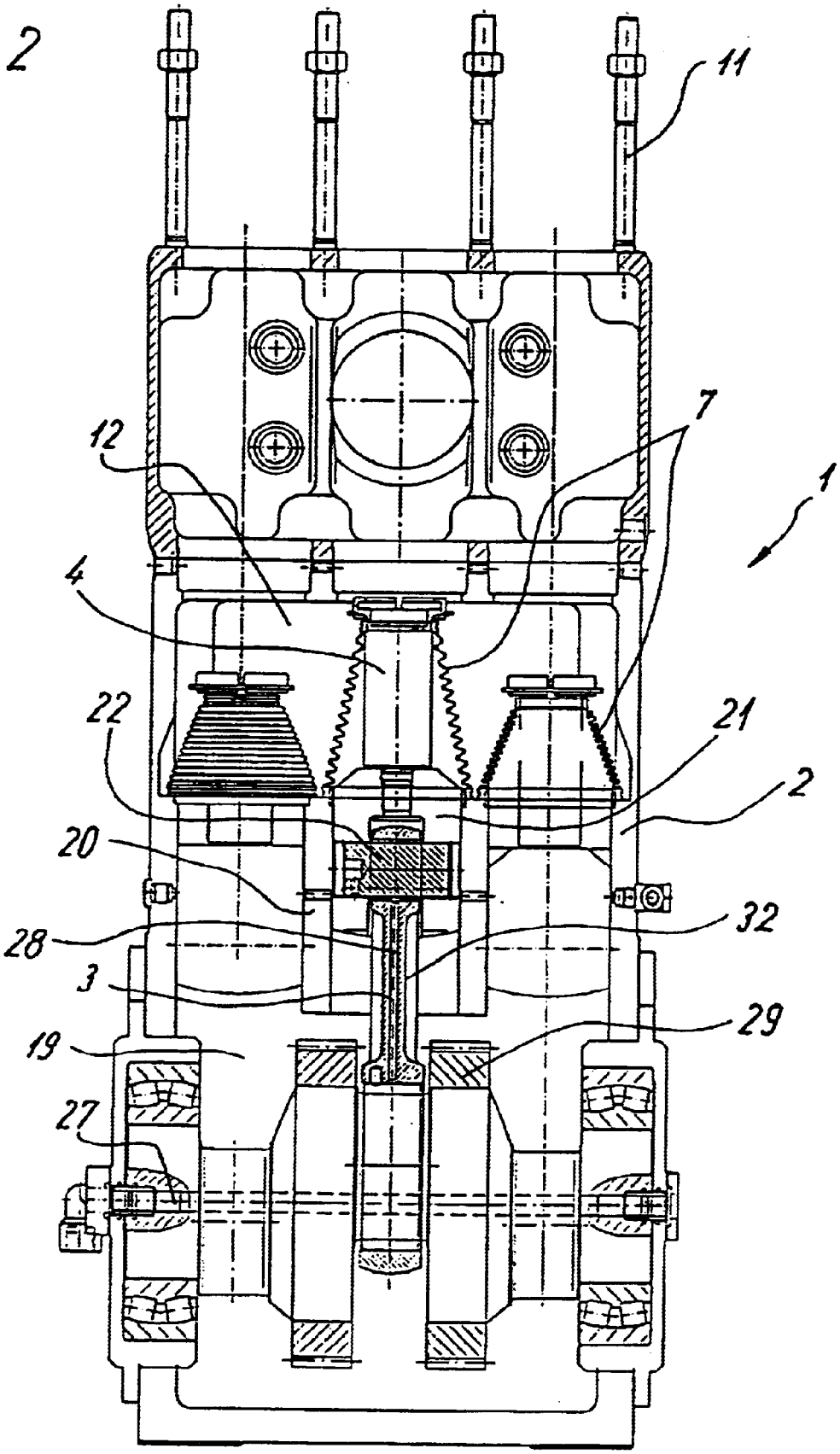
FIG. 2 is a sectional top view of the essential parts of the pump of FIG. 1.

A plunger pump 1, illustrated in FIGS. 1 and 2, comprises a one-part or multiple-part housing 2 in which a lower crank mechanism 3 is provided. The crank mechanism 3 is used for driving a plunger 5, which is constructed in several parts and comprises a lower plunger section 4. The plunger 5 is made of a highly wear-resistant material, such as ceramics or hard metal and slides without any contact pressure in a running sleeve or receiving device 51, which is not shown in detail, for sealing off the ring gap formed around the plunger 5. This receiving device 51 forms a high-pressure sealing and may be constructed as a labyrinth, packing or hydrodynamic seal. Below the receiving device 51, a low-pressure sealing 52 is provided which is constructed as a packing or elastomer sealing ring. As a result of the vertical construction, the plunger pump 1 can operate in a weight-neutral manner.

A pump head 6 is provided in the upper area of the housing 2. Ducts are constructed in the pump head 6 for guiding a fluid. The pump head 6 is fastened to the housing 2 by bolts 11.

For the pumping of a fluid, fluid is sucked into the space 8 from a suction space 9 during a downward movement of the plunger 5. As soon as the plunger 5 has passed through the lowest point, the plunger 5 moves upward and, by way of a valve, closes off the access by space 8 to the suction space 9. In addition, a valve 50 is operated which opens an access of space 8 to the pressure space 10. As a result of the upward movement of the plunger 5, starting with the generation of a certain pressure, the fluid is therefore pumped into the pressure space 10 from space 8 and is distributed by way of corresponding pipes.

For the sealing between a lower housing space 19, in which the crank mechanism 3 is arranged, and a space 12 filled with air, ring-shaped and conically constructed bellows 7 are provided. As a result of the conical and wave-shaped construction of the bellows 7, buckling is prevented during the movement of the plunger 5. One end of the bellows 7 is fastened to the plunger 5 at flange 43 on the lower plunger section 4. A ring-shaped section 14 of the bellows 7 is sealingly clamped at the flange 43 by a clamping element 15. An opposite end of the bellows 7 is sealingly fixed to a ring-shaped receiving device 17 by additional clamping elements. The receiving device 17 is integrally connected with the housing 2 by interior webs.

The bellows 7 are formed of a media-resistant and water-jet-resistant material so that the pump 1 can also be used under extreme conditions. The wall thickness of the flexible material of the bellows 7 amounts to approximately 1 to 2 mm.

In the illustrated embodiment, several plungers 5 are arranged side-by-side, as illustrated in FIG. 1. In this case, the crank mechanism 3 is driven by a pinion shaft 30 whose pinions mesh with one or several gear wheels 29. The gear wheels 29 are connected with a crankshaft. As a result of the eccentric mounting of the crank pins, an oscillating movement of the plunger 5 is generated. In this case, as shown in FIG. 2, a guiding element 21 is linked to a axis 22 at a piston rod 32. An oil pressure constant circulation lubrication is provided in the lower housing space 19. The guiding element 21 is guided in a receiving device 20. Thus, no high-expenditures sealing devices have to be provided between the guiding element 21 and the receiving device 20 because the bellows 7 provide a hermetic sealing and form a splash guard. This type of elastic sealing by the bellows 7 also prevents a wear of sealing devices, such as sliding guides, etc.

As illustrated in FIG. 2, in the illustrated embodiment, three plungers are mounted in the housing 2. It is also possible to combine fewer or more plungers in a pump unit.

Figure 3:
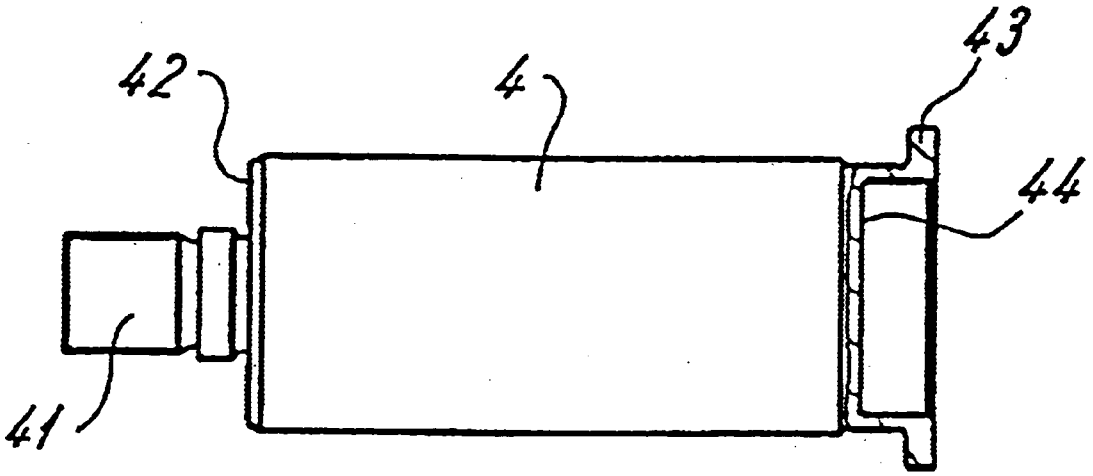
FIG. 3 is a detailed view of the lower plunger section.

As illustrated in FIG. 3, the lower plunger section 4 comprises a flange 43 for fastening the bellows 7. Inside the flange 43, a stop 44 is provided for the connection with the upper part of the plunger 5. On the opposite side, a pin 41 is constructed which engages in the guiding element 21. The pin 41 has a reduced diameter so that pressure forces can be removed from the guiding element 21 via a shoulder 42.

Although the present invention has been described and illustrated in detail, it is to be clearly understood that this is done by way of illustration and example only and is not to be taken by way of limitation. The spirit and scope of the present invention are to be limited only by the terms of the appended claims.

What is claimed is:

1. A pump comprising:

a housing including a pump head in an upper area of the housing and fixed to the housing for guiding a pressurized fluid withdrawn from a suction space;

a crank mechanism in a lower housing space of the housing for oscillating a plunger in the housing and guided in a receiving device;

a high pressure sealing element and a low pressure sealing element adjoining an intermediate space and around the plunger; and an elastic sealing device located in the intermediate space that is sealingly separated from the upper housing area by the sealing elements, the sealing device being fastened to the plunger and providing a pressure-tight sealing with respect to the lower housing space containing the crank mechanism.

2. The pump according to claim 1, wherein the sealing device is fastened on one end to the plunger and on the opposite end to the housing.

3. The pump according to claims 1, wherein the sealing device is one of a ring-shaped bellow and conical bellow.

4. The pump according to claim 1, wherein the sealing device provides a gastight seal between the lower housing space and the intermediate space.

5. The pump according to claim 1, wherein the sealing device forms a splash guard against oil from the lower housing space.

6. The pump according to claim 1, wherein the plunger is constructed in two or more parts.

7. The pump according to claim 1, including two or more adjacent plungers in the housing and connected to the crank mechanism, and a sealing device is connected to each plunger to seal each plunger with respect to the lower housing space.

8. The pump according to claim 1, wherein the pump is constructed as a high-pressure plunger pump.

9. The pump according to claim 1, wherein the intermediate space is filled with air.

* * * * *